United States Patent [19]

Becker

[11] 3,948,509

[45] Apr. 6, 1976

[54] CONTROL DEVICE FOR THE LATERAL STOP ON THE FEED TABLE OF SHEET FEEDS FOR FEEDING INDIVIDUAL SHEETS

[75] Inventor: Willi Becker, Bammental, Germany

[73] Assignee: Heidelberger Druckmaschinen Aktiengesellschaft, Heidelberg, Germany

[22] Filed: Nov. 22, 1974

[21] Appl. No.: 526,235

Related U.S. Application Data

[63] Continuation of Ser. No. 354,524, April 26, 1973, abandoned.

[30] Foreign Application Priority Data

Apr. 29, 1972 Germany ..... 2221186

[52] U.S. Cl. ..... 271/239; 271/240; 271/248

[51] Int. Cl.[2] ..... B65H 9/10

[58] Field of Search ..... 271/248, 249, 250, 236, 271/237, 238, 239, 240, 252

[56] References Cited

UNITED STATES PATENTS

| | | | |
|---|---|---|---|
| 1,214,232 | 1/1917 | Sinnott | 271/252 |
| 1,300,235 | 4/1919 | Anderson | 271/236 |
| 1,503,520 | 8/1924 | Stevens | 271/248 |
| 3,525,519 | 8/1970 | Jiruse | 271/252 |

FOREIGN PATENTS OR APPLICATIONS

| | | | |
|---|---|---|---|
| 89,651 | 12/1895 | Germany | 271/248 |

*Primary Examiner*—James B. Marbert
*Assistant Examiner*—Bruce H. Stoner, Jr.
*Attorney, Agent, or Firm*—Herbert L. Lerner

[57] ABSTRACT

A control device for the lateral stop on the feed table of a sheet feed device includes a control shaft mounted for axial displacement and rotary movement. A cam along with an operating lever and an actuating means are operable to effect the axial displacement and rotary movement of the control shaft whereby the lateral stop mounted on the control lever is raised and lowered relative to the feed table when the control shaft is rotated and the lateral stop is moved laterally when the control shaft is axially displaced.

4 Claims, 6 Drawing Figures

CONTROL DEVICE FOR THE LATERAL STOP ON THE FEED TABLE OF SHEET FEEDS FOR FEEDING INDIVIDUAL SHEETS

This is a continuation of application Ser. No. 354,524, filed Apr. 26, 1973, now abandoned.

This invention relates to a control device for the lateral stop on the feed table of sheet feed devices for feeding individual sheets. The control device is operable to raise the lateral stop off the feed table and subsequently lower it again on the feed table by means of a cam and interposed control elements, and in addition, to move the lateral stop back and forth on the feed table by means of a cam and interposed transmission elements.

Control devices for the lateral stop are known in which there is provided a separate drive for the raising and lowering of the lateral stop as well as a further drive for moving the lateral stop on the feed table.

Accordingly, an object of the present invention is to provide a control device for the lateral stop which is simpler and more space-saving than devices heretofore known.

The present invention is characterized by the feature that the lateral stop is attached to a control shaft which can be rotated about its longitudinal axis against the biasing force of a spring and which is also movable axially. A control member is provided on the control shaft and this control member cooperates with a stop for rotating the control shaft and selectively with two sliding surfaces disposed with respect to each other to form a V. The stop and the sliding surfaces are arranged on one lever arm of a bell crank or pivoted double lever. The other lever arm of the pivoted double lever has a roller which is biased by the tension of a spring against a driven, single-revolution cam. The control device according to the invention permits the raising and moving or lateral shifting of the lateral stop with only one cam. The entire control device can therefore be manufactured in a very compact, simple and, therefore, inexpensive manner.

Other features which are considered as characteristic for the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
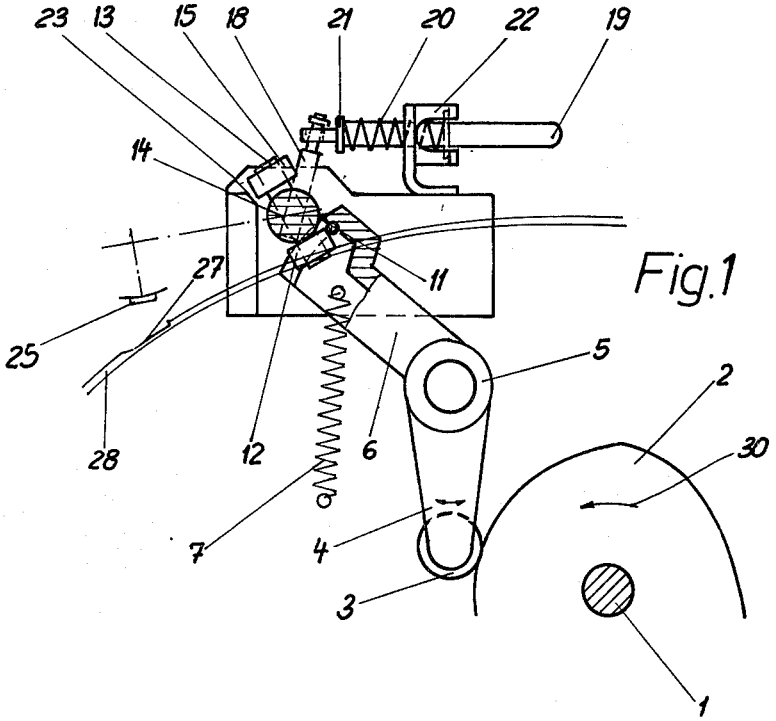
FIG. 1 is a schematic view of a control device according to one embodiment of the present invention showing the lateral stop in a raised position.
Figure 2:
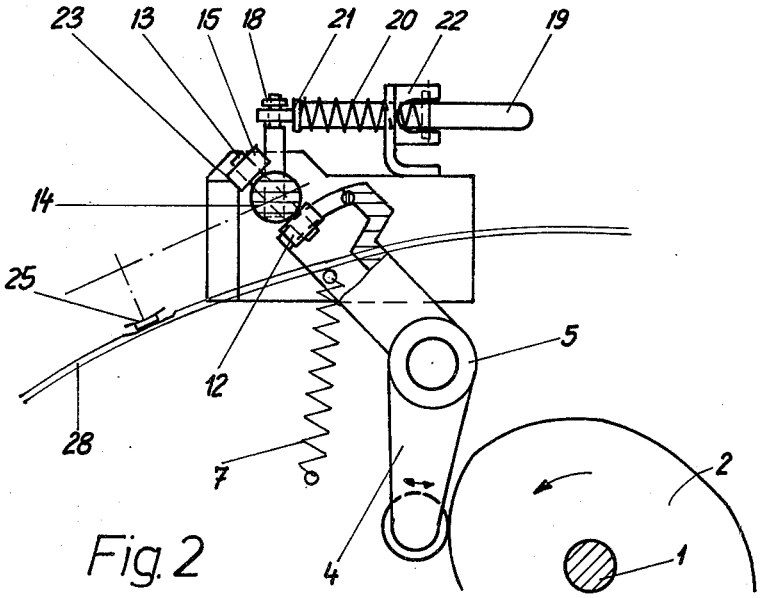
FIG. 2 is a view similar to FIG. 1 but showing the lateral stop in a lowered position.

Referring to the drawings, there is shown in FIGS. 1 and 2 a single-revolution shaft 1 which is driven by a feed (not shown) and which carries a cam 2 on which the roller 3 engages. This roller 3 is rotatably mounted on a lever arm 4 of a pivoted double or bell crank lever 5. At the other lever arm 6 of the double lever 5 there is secured a tension spring 7 which biases the double lever 5 in a counterclockwise direction, as viewed in FIGS. 1 and 2, so that the roller 3 is always biased to or disposed against the cam 2.

The free end of the lever arm 6 is bent or disposed at a right angle and is provided with a V-shaped groove 8. The legs of the V form sliding surfaces 9 and 10. By virtue of these two sliding surfaces 9 and 10, the bent or angled-off end of the lever arm 6 has the form of a V-shaped fork.

Paraliel to the fulcrum of the double lever 5 is a stop pin 11 which extends through the bottom of the fork and which is arranged in the free end of the lever arm 6. The stop pin 11 can therefore be considered to constitute the inward termination of the two sliding surfaces 9 and 10 of the V-shaped groove.

Within the V-shaped groove 8 there is a roller 12. The roller 12 may selectively be placed against the sliding surfaces 9 and 10 and the stop pin 11. The roller 12 is supported on a bearing post 13 which passes through a control shaft 14 and which is firmly secured to the control shaft 14. The free end of the bearing post 13 protrudes or extends from the control shaft 14 and is likewise provided with another roller 15. The control shaft 14 is rotatably supported in the side walls 16 and 17 of the sheet feeding device.

Attached to the control shaft 14 is a switching pin 18 which is linked to a switching rod 19. A compression spring 20 which bears, on the one hand, against a shoulder 21 on the switching rod 19 and, on the other hand, against a guide bracket 22 is disposed over the switching rod 19. The compression spring 20 is tensioned so that, depending on the position of the switching rod 19, it exerts a pressure on the switching pin 18 in such a manner that the control shaft 14 is biasingly urged to rotate counterclockwise and is biasingly urged to shift in an axial direction.

In the corresponding switching position of the double lever as shown in FIG. 2, the rotation of the control shaft 14 caused by the compression spring 20 delineates a stop surface 23 against which the roller 15 is placed or contacted.

Figure 3:
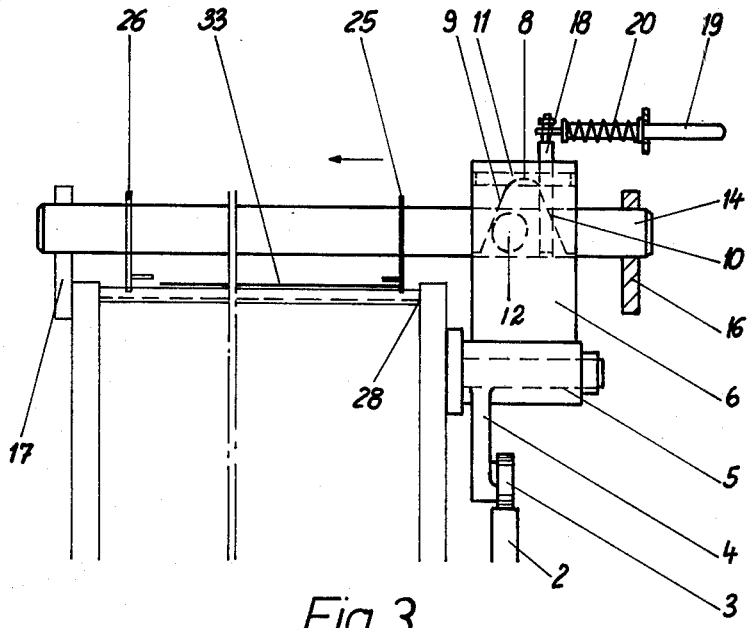
FIG. 3 is a top view of the control device shown in FIGS. 1 and 2.
Figure 4:
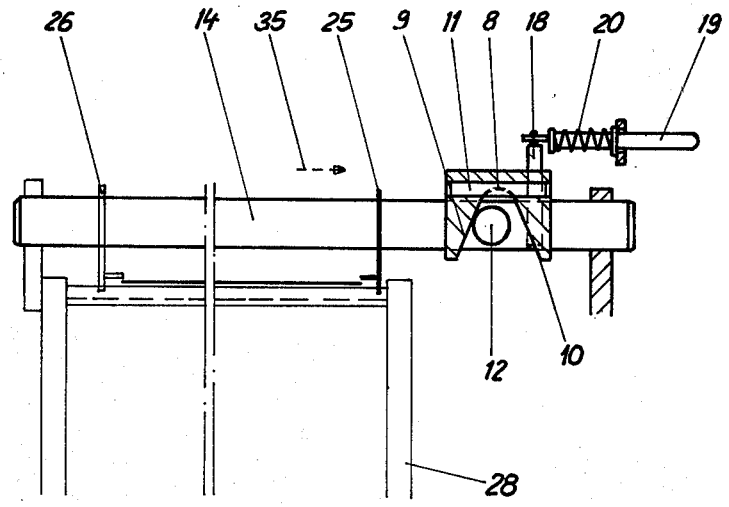
FIG. 4 is a view similar to FIG. 3 showing the lateral stop pulled back.

As shown in FIGS. 3 and 4 respectively, a right-hand lateral stop 25 and a left-hand lateral stop 26 are provided on the control shaft 24. As will be seen from FIGS. 1 and 2, the lateral stops 25 and 26 can be lowered into a recess 27 on a feed table 28.

The operation of the described device is as follows: Upon feeding of a sheet, the single-revolution shaft 1 rotates the cam 2 once by 360° in the direction of the arrow 30. In this process, the double lever 5 is rotated clockwise as viewed in FIGS. 1 and 2, against the bias of the spring 7, from the position shown in FIG. 1 into the position shown in FIG. 2. The stop pin 11 moves upward in the process and is lifted off the roller 12 when the roller 15 has engaged the stop surface 23.

Corresponding to the swinging or rotational motion of the double lever 5, the compression spring 20 of the switching rod 19 is able to impart this rotational motion to the control shaft 14, whereby the lateral stops 25 and 26 are lowered into the recess 27 in the feed table 28. Due to the direction of pressure of the compression spring 20, depending on the corresponding positioning of the switching rod 19, the roller 12 is pressed against the sliding surface 9 or 10 upon further upward movement of the arm 6. For example, in FIG. 5 the roller 12 contacts and rolls along this sliding surface 9 as the double lever 5 swings further, because the compression spring 20 moves the control shaft 14, via the switching pin 18, in an axial direction as indicated by the arrow 31 in FIG. 5 whereby the right-hand lateral stop 25 moves or shifts the sheet 33, which already rests against the front stops 32, on the feed table transversely to the direction of travel.

After the aforementioned shifting operation, the cam 2 has been advanced to the extent that it permits the double lever 5 to swing back due to the pulling force of the tension spring 7. As this occurs the roller 12 again runs along the sliding surface 9 of the V-shaped groove 8. Under these circumstances the control shaft 14 and therewith also the lateral stop 25 move in the direction of the arrow 35 shown in FIG. 4.

The swinging motion of the double lever 5 continues until the stop pin 11, which is located at the fork bottom of the groove 8, engages the roller 12 and swings the control shaft 14 back into the position shown in FIG. 1. In this position the roller 15 is again lifted off the stop surface 23 and the lateral stops 25, 26 are lifted from the feed table 28. In this lifted or raised position of the lateral stops 25 and 26, the aligned sheet can be taken from the feed table 28, and another sheet may be fed in and placed against the front stops 32.

Figure 5:
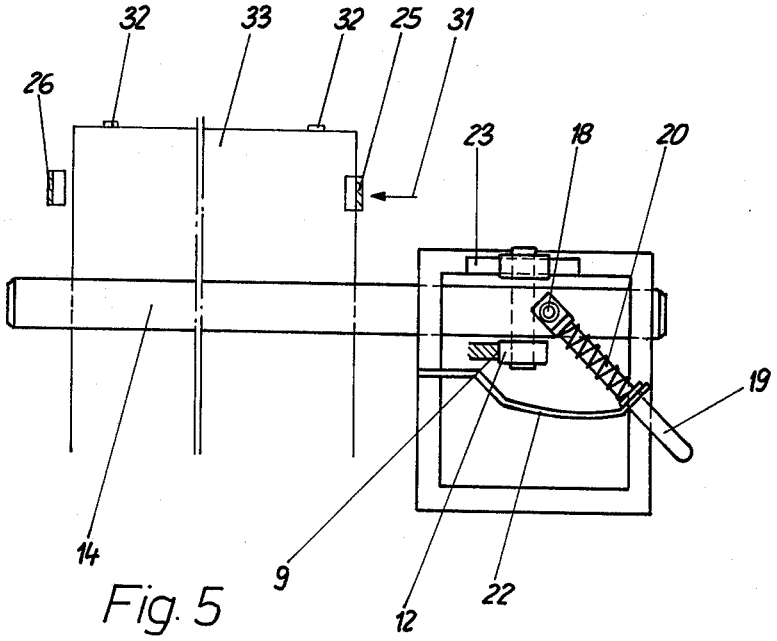
FIG. 5 is a view of the control device shown in FIGS. 1–4 showing the switching position of the parts of the control device for effecting lateral movement of the right-hand lateral stop.
Figure 6:
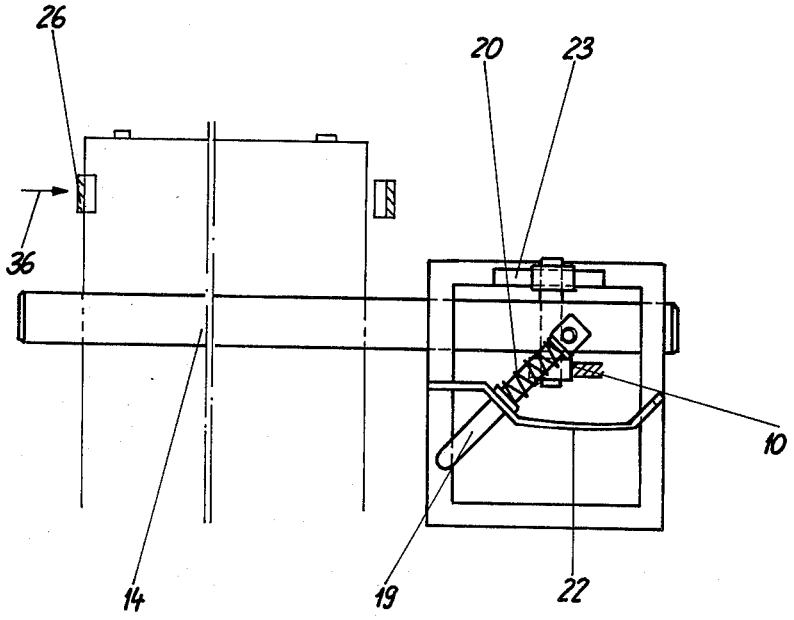
FIG. 6 is a view similar to FIG. 4 showing the switching position of parts of the control device for effecting lateral movement of the left-hand lateral stop.

In order to bring the left-hand lateral stop 26 into operation, it is only necessary to swing the switching rod 19 clockwise as viewed in FIG. 5 and to advance it or swing it from the switch position in FIG. 5 to the switching position shown in FIG. 6. When in this latter position, the other sliding surface 10 will be engaged when the double lever 5 swings and the compression spring 20 will cause a shift of the control shaft 14, and therefore, of the left-hand lateral stop 26, in the direction of the arrow 36 shown in FIG. 6. After the aforementioned sideways shift, when the double lever 5 is swung back, the control shaft 14 and therefore also the lateral stop 26 are returned to the starting position through the pressure of the compression spring 20.

I claim:

1. A control device for lateral stops on the feed table of a sheet feeding device comprising a control shaft rotatable about and displaceable substantially parallel to the longitudinal axis thereof, lateral stops carried by said control shaft, a first and a second roller mounted on said control shaft, lever means pivotable about a point intermediate the ends thereof, said lever means having at one end thereof a stop pin and a pair of sliding surfaces extending V-shaped toward one another, said second roller being disposed between said sliding surfaces, said lever means having at the other end thereof a follower roller, cam means engageable by said follower roller, and first and second spring means, said first spring means being connected to said lever means for continuously urging said follower roller into engagement with said cam means, said second spring means being operatively connected to said control shaft for rotating said control shaft about said longitudinal axis thereof until said first roller engages a stop surface disposed so as to stop said first roller in a given position wherein said lateral stops are lowered to the feed table, said lever means being pivotable in a given rotary direction wherein said second roller is slideable along one of said sliding surfaces so as to displace said control shaft and said lowered lateral stops in a first direction substantially parallel to the longitudinal axis of said control shaft simultaneously with the rotation of said control shaft until said first roller engages said stop surface, whereby one of said lowered lateral stops is moveable into engagement with a lateral edge of a sheet on the feed table, said lever means being also pivotable in a direction opposite to said given rotary direction wherein said second roller is slideable along said one of said sliding surfaces so as to displace said control shaft in a second direction opposite to said first direction whereby said one lateral stop is movable out of engagement with the lateral edge of the sheet on the feed table, said lever means being further pivotable in said direction opposite to said given rotary direction until said stop pin bears against said second roller so as to rotate said control shaft about said longitudinal axis thereof against the rotating action of said second spring means whereby said lateral stops are raised from the feed table.

2. A control device according to claim 1 including a bearing pin secured to said control shaft and extending radially therethrough, said first and second rollers being mounted respectively at the opposite ends of said bearing pin.

3. A control device according to claim 1 including a switch pin secured to said control shaft, said switch pin having a free end, a switchable switch rod spring-loaded by said second spring means, said switch rod being actuable to rotate said control shaft in a given rotary direction depending upon the position of said lever means, said control shaft being displaceable in alternate directions substantially parallel to the longitudinal axis thereof in accordance with a selected switching position of said switch rod.

4. A control device according to claim 1 wherein said sliding surfaces are located on respective legs of a fork-shaped portion of said lever means, said stop pin being in engagement with said sliding surfaces at the base of said fork-shaped portion.

* * * * *